US010980705B2

(12) United States Patent
Ellin

(10) Patent No.: US 10,980,705 B2
(45) Date of Patent: Apr. 20, 2021

(54) DEVICE FOR TREATMENT OF PERIPHERAL ARTERIAL DISEASE AND MICRO-ANGIOPATHY IN LOWER LIMBS

(71) Applicant: VIBRANT MEDICAL LIMITED, Sheffield South Yorkshire (GB)

(72) Inventor: Philip Ellin, South Yorkshire (GB)

(73) Assignee: VIBRANT MEDICAL LIMITED, Sheffield (GB)

( * ) Notice: Subject to any disclaimer, the term of this patent is extended or adjusted under 35 U.S.C. 154(b) by 971 days.

(21) Appl. No.: 14/894,975

(22) PCT Filed: May 30, 2014

(86) PCT No.: PCT/GB2014/051675
§ 371 (c)(1),
(2) Date: Nov. 30, 2015

(87) PCT Pub. No.: WO2014/191775
PCT Pub. Date: Dec. 4, 2014

(65) Prior Publication Data

US 2016/0106621 A1 Apr. 21, 2016

(30) Foreign Application Priority Data

May 30, 2013 (GB) ..... 1309645

(51) Int. Cl.
*A61H 23/00* (2006.01)
*A61H 23/02* (2006.01)

(52) U.S. Cl.
CPC . *A61H 23/0263* (2013.01); *A61H 2023/0281* (2013.01); *A61H 2201/0146* (2013.01);
(Continued)

(58) Field of Classification Search
CPC ..... A61H 23/0263; A61H 2201/5038; A61H 2201/5041; A61H 2201/5035;
(Continued)

(56) References Cited

U.S. PATENT DOCUMENTS 2,852,020 A 9/1958 Murphy
2,917,043 A 12/1959 Murphy
(Continued)

FOREIGN PATENT DOCUMENTS

GB 2448995 A1 5/2008
GB 2479735 A 10/2011
(Continued)

OTHER PUBLICATIONS

Communication pursuant to Article 94(3) EPC issued for European Patent Application No. 14 728 266.9-1658 dated Dec. 13, 2017.
(Continued)

*Primary Examiner* — Timothy A Stanis
(74) *Attorney, Agent, or Firm* — Jeffrey G. Sheldon; Katherine B. Sales; Cislo & Thomas LLP

(57) ABSTRACT

A vibratory treatment device has a motor driving an output shaft on which is mounted an eccentric weight to create vibration of the motor as the shaft rotates. A frame is connected to the motor to which frame said vibrations are transmitted through the connection of the frame to the motor. A pad surrounds the frame and into which said vibrations of the frame are transmitted. The pad is applied to the affected limb or limbs of the patient and activated to cause vibrations of the motor to be transmitted through the frame and pad into the tissue of the patent's limb or limbs. The treatment is continued for a therapeutically effective period of time and repeated periodically.

11 Claims, 8 Drawing Sheets

(52) U.S. Cl.
CPC ..... *A61H 2201/0149* (2013.01); *A61H 2201/1642* (2013.01); *A61H 2201/5035* (2013.01); *A61H 2201/5038* (2013.01); *A61H 2201/5041* (2013.01); *A61H 2201/5071* (2013.01); *A61H 2205/106* (2013.01)

(58) Field of Classification Search
CPC .... A61H 2201/0146; A61H 2201/0149; A61H 2205/106
See application file for complete search history.

(56) References Cited

U.S. PATENT DOCUMENTS

| | | | | |
|---|---|---|---|---|
| 2,939,454 | A | 6/1960 | Lichtenstein et al. | |
| 3,019,785 | A | 2/1962 | Eiden | |
| 3,580,245 | A | 5/1971 | Dill | |
| 3,841,320 | A | 10/1974 | Brown, Jr. | |
| 5,532,003 | A * | 7/1996 | Wong | A61K 9/0004 424/473 |
| 5,951,500 | A * | 9/1999 | Cutler | A61H 1/00 601/46 |
| 5,989,245 | A * | 11/1999 | Prescott | A61N 5/0603 606/14 |
| 6,155,976 | A | 12/2000 | Sackner et al. | |
| 7,090,648 | B2 * | 8/2006 | Sackner | A61H 1/001 601/1 |
| 8,764,688 | B1 * | 7/2014 | Nauman | A61H 23/0263 601/46 |
| 2004/0077978 | A1 * | 4/2004 | Nelson | A61H 1/0237 601/70 |
| 2007/0049853 | A1 | 3/2007 | Adams et al. | |
| 2008/0125834 | A1 * | 5/2008 | Hendrix | A61N 5/0616 607/88 |
| 2012/0046579 | A1 * | 2/2012 | Radl | A61H 11/00 601/46 |
| 2015/0182410 | A1 * | 7/2015 | Burris | A61K 31/727 601/151 |

FOREIGN PATENT DOCUMENTS

| | | | |
|---|---|---|---|
| WO | WO02065973 | A1 | 8/2002 |
| WO | WO03088889 | A1 | 10/2003 |
| WO | WO2008135788 | A1 | 11/2008 |

OTHER PUBLICATIONS

Photos of Grundig RP500 as disclosed in D9 of IPRP dated Dec. 1, 2015, Jun. 1995 (1995-006) XP055141617.
Vibrant Medical Limited, International Search Report and Written Opinion of the International Searching Authority issued for International Patent Application No. PCT/GB2014/051675 dated Sep. 29, 2014.
Vibrant Medical Limited, Great Britain Search Report Under Section 17(5) dated Nov. 20, 2013, GB1309645.8.
Grundig: "Grundig Service Manual, Sach-Nr. 72010-519.40".
Vibrant Medical Limited, International Preliminary Report on Patentability of the International Searching Authority issued for International Patent Application No. PCT/GB2014/051675 dated Dec. 1, 2015.
Vibrant Medical Limited, Great Britain Examination Report dated Mar. 1, 2017 from Application No. GB1309645.8.
L. Norgren, W. R. Hiatt, J. A. Dormandy, M. R. Nehler, K. A. Harris, and F. G. R. Fowkes, "Inter-society consensus for the management of peripheral arterial disease (TASC II)," Journal of Vascular Surgery, 2007 vol. 45, No. 1, pp. S5-S67.
Meijer WT, Hoes AW, Rutgers D, Bots ML, Hofman A, Grobbee DE: Peripheral arterial disease in the elderly: The Rotterdam Study. Arterioscler Thromb Vasc Biol 1998, 18(2):185-192.
Criqui MH, Langer RD, Fronek A, Feigelson HS, Klauber MR, McCann TJ, Browner D: Mortality over a period of 10 years in patients with peripheral arterial disease. N Engl J Med 1992, 326(6):381-386.
Shammas NW, Dippel EJ.. Evidence-based management of peripheral vascular disease. Curr Atheroscler Rep, 2005. 7:358-63.
Norgren L, Hiatt WR, Dormandy JA, Nehler MR, Harris KA, Fowkes FG, TASC II Working Group. Inter-society Consensus for the management of peripheral arterial disease (TASC II). Eur J Vasc Endovasc Surg 2007;33:S1e75.
Anna Franzone, Marco Ferrone, Giuseppe Carotenuto, Andreina Carbone, Laura Scudiero et al.The role of atherectomy in the treatment of lower extremity peripheral artery disease. BMC Surgery 2012, 12(Suppl 1):S13.
Lower limb peripheral arterial disease. Methods, evidence and recommendations. NICE Clinical guideline 147 UK. Aug. 2012.
Makris GC, Lattimer CR, Lavida A, Geroulakos G. Availability of Supervised Exercise Programs and the Role of Structured Home-based Exercise in Peripheral Arterial Disease. Eur J Vasc Endovasc Surg. Dec. 2012;44(6):569-75. doi: 10.1016/j.ejvs.2012.09.009. Epub Sep. 30, 2012.
Müller-Bühl U, Engeser P, Leutgeb R, Szecsenyi J. Low attendance of patients with intermittent claudication in a German community-based walking exercise program. Int Angiol. Jun. 2012;31(3):271-5.
R. M. J. Palmer, D. S. Ashton, and S. Moncada, Vascular endothelial cells synthesize nitric oxide from L-arginine. Nature, 1988 vol. 333, No. 6174, pp. 664-666.
R. H. Böger, S. M. Bode-Böger, W. Thiele, W. Junker, K. Alexander, and J. C. Frölich, Biochemical evidence for impaired nitric oxide synthesis in patients with peripheral arterial occlusive disease. Circulation, 1997 vol. 95, No. 8, pp. 2068-2074.
Button C., Anderson N., Bradford C., Cotter JD. and Ainslie PN. The effect of multidirectional mechanical vibration on peripheral circulation of humans. Clin Physiol Funct Imaging. Jul. 2007(4):211-6.
Sackner MA, Gummels E, Adams JA. Nitric Oxide is released into circulation with whole-body, periodic acceleration. Chest, 2005. 127: 30-39.
Lievens P. Professor (PHD). Influence of Cycloidal Vibration on skin blood flow changes observed in vivo microcirculatory blood vessel. Head of the department of Medical Rehabilitation Research. Faculty of Medicine,Vrije Universiteit Brussel, presented: Wounds UK 2011 conference.
Gojiro Nakagami, Hiromi Sanada, Noriko Matsui, Atsuko Kitagawa, Hideki Yokogawa, Naomi Sekiya, Shigeru Ichioka, Junko Sugama, Masahiro Shibata. Effect of vibration on skin blood flow in an in vivo microcirculatory model. BioScience Trends. 2007. 1(3): 161-166.
Ichioka S, Yokogawa H, Nakagami G, Sekiya N, Sanada H. In vivo Analysis of Skin Microcirculation and the Role of Nitric Oxide During Vibration. Ostomy Wound Manage. Sep. 2011; 57(9):40-7.
Maloney-Hinds C, Petrofsky JS, Zimmerman G). The role of Nitric Oxide in skin blood flow increases due to vibration in healthy adults and adults with type 2 diabetes. Diabetes Technology and Therapeutics. 2009,11:1; 39-43.
Watson L, Ellis B, Leng GC. Exercise for intermittent claudication. Cochrane Database Syst Rev 2008;(4): CD000990.
S. M. Bode-Böger, R. H. Böger, H. Alfke et al., "L-arginine induces nitric oxide-dependent vasodilation in patients with critical limb ischemia: a randomized, controlled study," Circulation, 1996, vol. 93, No. 1, pp. 85-90.
Ziche and L. Morbidelli, Nitric oxide and angiogenesis, Journal of Neuro-Oncology, 2000, vol. 50, No. 1-2, pp. 139-148.
Ingber D. Mechanical Signaling and the Cellular Response to Extracellular Matrix in Angiogenesis and Cardiovascular Physiology. Circ Res. Nov. 15, 2002;91(10):877-87.
Suhr F, Brixius K, de Marées M, Bölck B, Kleinöder H, Achtzehn S, Bloch W, Mester J.Effects of short-term vibration and hypoxia during high-intensity cycling exercise on circulating levels of angiogenic regulators in humans. Appl Physiol.2007. 103: 474-483.
Burnstock G, Ralevic V . New insights into the local regulation of blood flow by perivascular nerves and endothelium. Br J Plast Surg. 1994.47:527-543.
Rowell LB. Reflex control of regional circulations in humans. J Auton Nerv Syst. 1984. 11:101-114.

* cited by examiner

DEVICE FOR TREATMENT OF PERIPHERAL ARTERIAL DISEASE AND MICRO-ANGIOPATHY IN LOWER LIMBS

CROSS-REFERENCE TO RELATED APPLICATIONS

The present Application is a national phase of International Patent Application PCT/GB2014/051675, filed May 30, 2014, titled "Device For Treatment Of Peripheral Arterial Disease And Micro-Angiopathy In Lower Limbs" which claims the benefit of Great Britain Patent Application 1309645.8, filed May 30, 2013, the contents of which are incorporated in this disclosure by reference in their entirety.

The present invention relates to the treatment of peripheral arterial disease and other conditions, as well as to apparatus therefor.

BACKGROUND

Three-dimensional sinusoidal vibration (referred to as cycloidal vibration) has beneficial effects in improving blood circulation, joint mobility, and respiratory conditions, and relieving tension. Such vibration is in the frequency range of 15 to 75 Hz with an amplitude varying between 0.1 and 2 mm, depending on the orthogonal direction.

Peripheral arterial disease (PAD) causes considerable morbidity and mortality and estimates state that it affects 12% to 14% of individuals in the western world (1). It is a strongly age related disorder with an occurrence of around 20% of the population over 60 years old (2). Occlusive disease of the large and medium sized arteries in the lower limbs due to artherosclerosis reduces blood flow to the lower limb muscles often resulting in intermittent claudication which reduces a patient's mobility. The risks and incidence of mortality due to cardiovascular disease and stroke with PAD patients is significant (3). In severe cases of PAD critical limb ischemia, gangrene, and limb loss can occur; risk factors for PAD include tobacco smoking, diabetes mellitus and hypertension (4). In standard care guidelines, smoking cessation, exercise and pharmacological interventions are often recommended or, if PAD is severe, revascularisation procedures such as angioplasty, stenting or bypass surgery are performed. The success rate of each intervention has been widely studied and all have been shown to improve patient health and quality of life at the appropriate stages and severity of PAD (5). Lower extremity PAD can be more difficult to manage especially with diabetics and has resulted in the development of a number of endovascular re-vascularisation techniques (6).

Intermittent claudication (IC) is defined as pain in the muscles of the calf, thigh or buttock which comes during and after walking. The pain is caused by diminished circulation and the severity of PAD will determine the walking distance before pain. Exercise has been shown to improve peripheral circulation, provide symptomatic relief and improve walking distance before pain. In guidelines, supervised exercise training is often recommended for a minimum of 2 hours per week for a minimum of 12 weeks (7). Currently supervised exercise is not widely available across Europe (8) and patient compliance can be low, with a recently recorded 16% of applicable patients completing a supervised exercise programme over 3 months (9).

Vascular produced nitric oxide (NO) by endothelial nitric oxide synthase (NOS) is an important vasodilator to regulate vascular smooth muscle tone and retain healthy blood flow. NO also has a role in the endocrine and paracrine systems, including inhibition of platelet adhesion and aggregation; suppression of inflammatory mediators; inhibition of smooth muscle proliferation and migration; and, promotion of endothelial survival and repair (10). Disruption of nitric oxide (NO) producing pathways may affect the pathogenesis of PAD (11).

Studies have shown that the non-invasive application of sinusoidal vibration therapy (SVT) frequencies to skin tissue can increase blood flow (12). The transmission of these vibrations into the tissues generate a range of mechanical forces and stresses on vascular endothelial cells, resulting in a vasodilatory response (13). Increase in blood flow due to SVT has been demonstrated in in-vivo circulatory model studies (14,15).

Cycloidal vibrations may be usefully applied to the treatment of micro-vascular disease, termed micro-angiopathy.

WO-A-02/065973 and WO-A-2008/135788 both disclose a vibratory device useful in the treatment of ulcers, lymphoedema and prophylactically of deep vein thrombosis. The features of such a device are incorporated herein by reference.

It is an object of the present invention to provide an improved method of treatment of peripheral arterial disease or micro-angiopathy, and suitable apparatus for effecting the method.

BRIEF SUMMARY OF THE DISCLOSURE

In accordance with the present invention there is provided a method of treatment of peripheral arterial disease affecting the limbs of a patient, said method comprising applying a therapeutically effective regime of vibration therapy comprising the steps of:

providing a vibratory treatment device having a motor driving an output shaft on which is mounted an eccentric weight to create vibration of the motor as the shaft rotates, a frame connected to the motor to which frame said vibrations are transmitted through the connection of the frame to the motor and a pad surrounding the frame and into which said vibrations of the frame are transmitted;

applying the pad to the affected limb or limbs of the patient and activating the motor to cause vibrations of the motor to be transmitted through the frame and pad into the tissue of the patent's limb or limbs; and continuing said application for a therapeutically effective period of time and repeating said application periodically.

Preferably, said vibrations have a frequency of between 15 and 75 Hz, and an amplitude of between 0.1 and 2 mm.

Preferably, said vibrations have components in three orthogonal directions, said frequency being the same in each direction. The amplitude may be the same or different in each direction.

Preferably, said therapeutically effective period of time is more than fifteen minutes, conveniently between twenty and forty minutes, or about thirty minutes. The treatment may be repeated two or three times a day.

In an alternative embodiment the method may be applied to the treatment of micro-angiopathy.

In another aspect, the present invention provides a treatment device for treatment of peripheral arterial disease in lower limbs of patients, the treatment device comprising:

a drive unit including a motor having an eccentric weight on its output shaft adapted to deliver mechanical vibrations at its surface in three orthogonal directions at a frequency in each orthogonal direction of between 15 and 75 Hz and with an amplitude in each orthogonal direction of between 0.1 and 2 mm;

a frame connected to said drive unit; and a pad disposed about said frame, whereby said mechanical vibrations are transmitted into said pad; wherein the pad is a generally flat having four sides and top and bottom surfaces;

the drive unit is along a top edge of the pad, side edges depending therefrom and a bottom edge joining said side edges at their ends remote from said top edge; and the side edges are spaced from one another by an amount sufficient that an adult male patient of average size is able to rest simultaneously the calves of both legs on the pad with the top edge under the knees of the patient and the bottom edge nearer the ankle than the knee, whereby the method of claim 1 may be employed on both legs simultaneously.

The spacing between the side edges of the pad may be between 300 and 450 mm, preferably between 350 and 400 mm. The spacing between the top and bottom edges of the pad may be between 400 and 700 mm, preferably between 500 and 600 mm. The top edge may be longer than the bottom edge, whereby the pad is trapezoidal in plan view. Indeed, in one embodiment, the top edge is between 350 and 375 mm in length and the bottom edge is between 325 and 350 mm in length.

The treatment device may further comprise a recorder to detect the periods of use of the device and record such use for subsequent analysis. It may further comprise a disabler to disable the device after a predetermined number of cycles of use have been completed as per a set treatment regime. It may comprise a start button which, on activation, starts the motor and, once the motor is started, the motor cannot be stopped for a predetermined period of time. These facilities of the device assist patient compliance.

First, recording the use of the device enables carers to explain why progress is less than expected, if patients are not undertaking the proper course of treatment, or, if they are, that possibly surgical or another intervention is indicated if the vibration treatment does indeed appear to be ineffective. Preferably, the recorder includes a leg detector that detects the application of a person's leg to the surface of the pad. The leg detector may be a pressure sensor that detects the pressure applied by the weight of a leg resting on the pad.

Second, disabling the device after a set number of cycles and maintaining the device on, once it has been switched on, both serve to encourage users to undertake a set period or regime of treatment. Thus once it has switched on, the treatment period has started and it will not be repeated, so that it will be lost to patient unless he or she sees it through.

Preferably, the device is powered by a battery or rechargeable battery. In the case of a rechargeable battery, the device may be hardwired to the battery that drives the motor, a charging port being provided to enable charging of the battery when it is discharged and when it is connected to a mains adapter. By "hardwired" is meant not merely connection by a cable, but also that the cable has no user-actuatable connector to selectively permit disconnection of the battery from the device.

A controller may be provided for selective connection to the motor, which controller is programmable to enable a set regime of vibration treatment to be applied.

In another aspect, the present invention provides a treatment device, the treatment device comprising:

a drive unit including a motor having an eccentric weight mounted on its shaft and adapted to deliver mechanical vibrations at its surface in three orthogonal directions at a frequency in each orthogonal direction of between 15 and 75 Hz and with an amplitude in each orthogonal direction of between 0.1 and 2 mm;

a frame connected to said drive unit to transmit vibrations to a vibration applicator;

a power source to drive the motor; and a controller for selective connection and disconnection to the drive unit, which controller is programmable to enable a set regime of vibration treatment to be applied.

The controller is optionally programmed to permit a preset number of treatment cycles before being disabled. The controller may be programmed to permit a preset number of treatment cycles per day. The controller may be programmed to permit said preset number of treatment cycles per day within preset timeframes during a day and/or with preset minimum time delays between succeeding treatment cycles. A treatment cycle may comprise a period of operation of the motor for between 20 and 40 minutes, for example about 30 minutes.

The vibration applicator may be selected from the group comprising:

a pad;

a seat-back cushion a seat-seat cushion; and a mattress.

In one embodiment, the controller comprises:

a casing, having button apertures on a surface thereof to locate user actuatable buttons and a tool aperture for access by a tool;

a circuit board disposed in the casing and having button switches in positions corresponding to said button apertures and a tool switch in a position corresponding with said tool aperture;

at least one button in a button aperture for operation, when depressed, of the corresponding button switch on the circuit board;

blanking plates in any button apertures not incorporating buttons, whereby the button switches corresponding with said blanking plates are not employed;

a main cover plate on the controller, which main cover plate covers said blanks and some of the surface of the casing surrounding said blanks and makes available for actuation the button or buttons received in button apertures; and a separate removable cover plate, which removable cover plate covers said tool aperture; whereby a controller may have a circuit board that is capable of providing different functionality depending on:

a) which button switches are accessible by having buttons in the corresponding button apertures; and b) what condition the tool switch is in, which condition is selectable by operation of the tool switch using a tool through the tool aperture after removal of said removable cover.

Some of button switches may be minor button switches and only be employed in only some functionalities of the controller, the buttons to operate said minor button switches are minor buttons and are integral with a button pad, wherein each minor button comprises a probe adapted to complete a switch circuit printed on the board, the probe and switch circuit constituting a said minor button switch, said cover making the minor buttons available for actuation by comprising holes through which the minor buttons protrude.

Some button switches may be major button switches and be employed in other functionalities of the controller and comprise a switch device disposed on the circuit board, said button to actuate a major button switch being a major button and comprising a transmission rod for reception in the respective button aperture, said cover making the major buttons available for actuation by comprising a flexible membrane over said major buttons whereby said disc is displaceable by depression of the flexible membrane to actuate said switch device.

The controller may comprise a start button which, on activation, starts the motor and, once the motor is started, the controller cannot be actuated to stop the motor before a predetermined period of time of a treatment cycle has elapsed.

The device may be powered by a rechargeable battery. The drive unit optionally is hardwired to the battery that drives the motor, a charging port being provided to enable charging of the battery when it is discharged and when it is connected to a mains adapter.

The treatment device of this aspect may have the features of a treatment device of the preceding aspect.

The benefit of the foregoing arrangement is that a single controller, subject to minor changes may provide several modes of operation and be easily adapted to each.

In a first mode, the controller is for medical use, either for treatment of PAD as described above, or micro-angiopathy (see below), or indeed for treatment of other conditions such as described in WO-A-02/065973 and WO-A-2008/135788. For these conditions prescribed treatment times and vibration modes are dictated and do not require capacity for adjustment. Accordingly, said minor buttons can be excluded entirely from the controller and said tool switch operated to a fixed operational characteristic. This can include a fixed number of treatment cycles, each for a fixed time period, according to a fixed regime, if desired and where the device is for home use by a patient.

In a second mode, the minor buttons may be employed because additional functionality is required. This may be in the context of a "consumer" unit where a customer wants relaxation as well as therapeutic treatment and needs to be able to adjust the time period of operation and the frequency and/or amplitude of vibration applied.

In a third mode, the controller might be employed where two motors are employed, for example in a mattress, where one motor may be operating a vibration device at a leg end of a mattress while a second motor operates one at a head or shoulders end of the mattress. This would also apply potentially to a chair where a seat and back-rest have different motors. It may be desirable to be able to adjust the time, frequency and amplitude of each motor independently.

These modes of operation are conveniently switched by the tool switch before the removable cover is first applied. However, it is within the ambit of the present invention that the mode may be changed in use by removing the removable cover and changing the mode selected using the appropriate tool, such as a screw-driver if the tool switch is a rotary switch.

The present invention also provided a method of treatment of micro-angiopathy affecting the limbs of a patient, said method comprising applying a therapeutically effective regime of vibration therapy comprising the steps of:

providing a vibratory treatment device having a motor driving an output shaft on which is mounted an eccentric weight to create vibration of the motor as the shaft rotates, a frame connected to the motor to which frame said vibrations are transmitted through the connection of the frame to the motor and a pad surrounding the frame and into which said vibrations of the frame are transmitted;

applying the pad to the affected limb or limbs of the patient and activating the motor to cause vibrations of the motor to be transmitted through the frame and pad into the tissue of the patent's limb or limbs; and continuing said application for a therapeutically effective period of time and repeating said application periodically.

The method may have the features of the method described above for treatment of peripheral arterial disease.

BRIEF DESCRIPTION OF THE DRAWINGS

Embodiments of the invention are further described hereinafter with reference to the accompanying drawings, in which.

DETAILED DESCRIPTION

Figure 1:
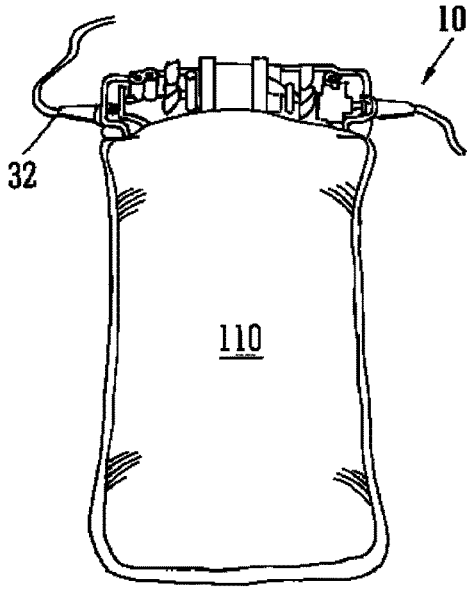
FIG. 1 is a perspective view of a known vibratory device.

Referring In the drawings, a known vibratory device 10 comprises a drive unit 12. Such a device is shown and described in WO-A-02/065973 and WO-A-2008/135788. The drive unit comprises a casing 14 housing an electric low voltage DC motor 16 mounted in the casing through flexible mountings 18,20. The motor drives an eccentric weight 22 mounted on a fan 23 on each end of an armature 24. On rotation of the armature 24, motor 16 imparts a vibration in the casing 14 in a radial plane (x,y) with respect to the armature 24. Because the mountings 18,20 are soft, a component of the vibration occurs in a direction orthogonal (z) to the radial plane. Consequently, the vibration of the casing in response to the vibration of the motor is three-dimensional.

To the casing 14 is fixed a frame 27, by screws (not shown) retained in apertures 25 of the casing. On the frame is disposed fabric cushioning to form a pad 110. The cushioning covers the drive unit 12 with a sleeve 40.

The motor is adapted to rotate at about 2400 rpm providing a frequency of vibration of about 40 Hz. Depending on various factors (primarily connected with the degree of restraint placed upon the device by its location on the limb of a person or animal) the amplitude of vibration in each direction may be different and between about 0.1 mm and 2 mm.

However, a speed control arrangement may be provided, conveniently disposed in a separate hand unit (not shown).

Further description of a suitable control arrangement may be had by reference to WO-A-02/065973 and WO-A-2008/135788.

Figure 2:
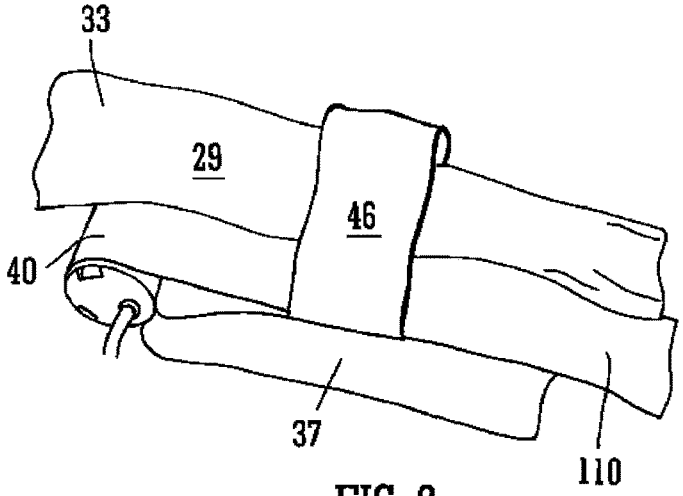
FIG. 2 is a side view of the device of FIG. 1 strapped to a patient's leg with the drive unit under the knee of the patient.
Figure 3:
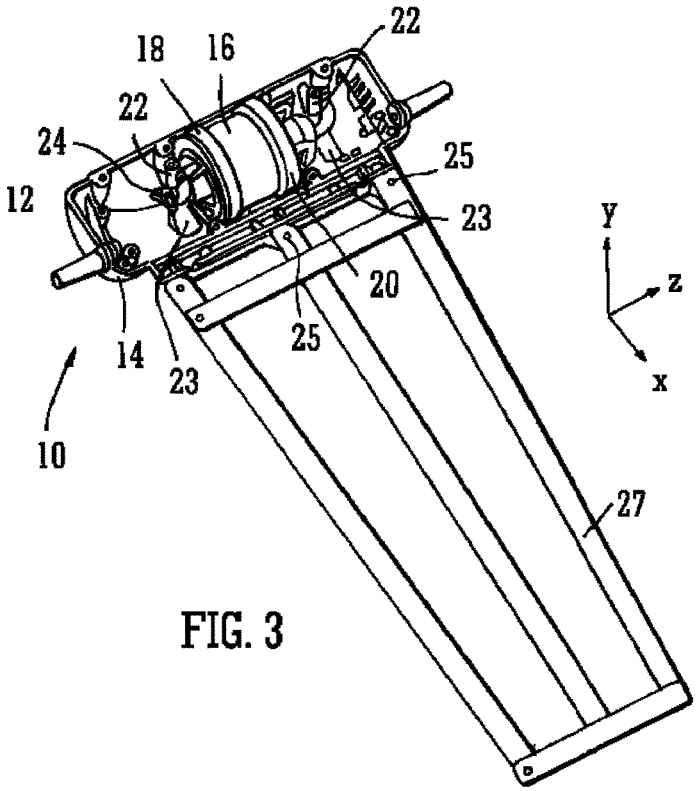
FIG. 3 is an assembly drawing of a drive unit and frame of the device of FIG. 1.

In use, a patient requiring treatment lays the affected leg 29 longitudinally along the pad. Whether the motor is at the heel end of the leg or is under the knee 33, as shown in FIG. 2, is a matter of choice. Pressure applying means in the form of a strap 46 can be employed to press the leg into close contact with the pad 110. The strap 46 conveniently is separate from the pad and comprises a band of material having hooped nylon on one surface and hooked nylon on the other. When its ends are overlapped and pressed together after wrapping around the patient's leg and pad, the strap secures the pad to the patient's leg. The strap may be about 100 mm wide. A cover for the pad may be provided, and a strap integrated with the cover. The use of a cover is not necessitated by the present invention since it is not concerned with patient's having wounds or ulcers that may exude liquid contaminants. Also, the use of a pressure applying means is not required.

Figure 4:
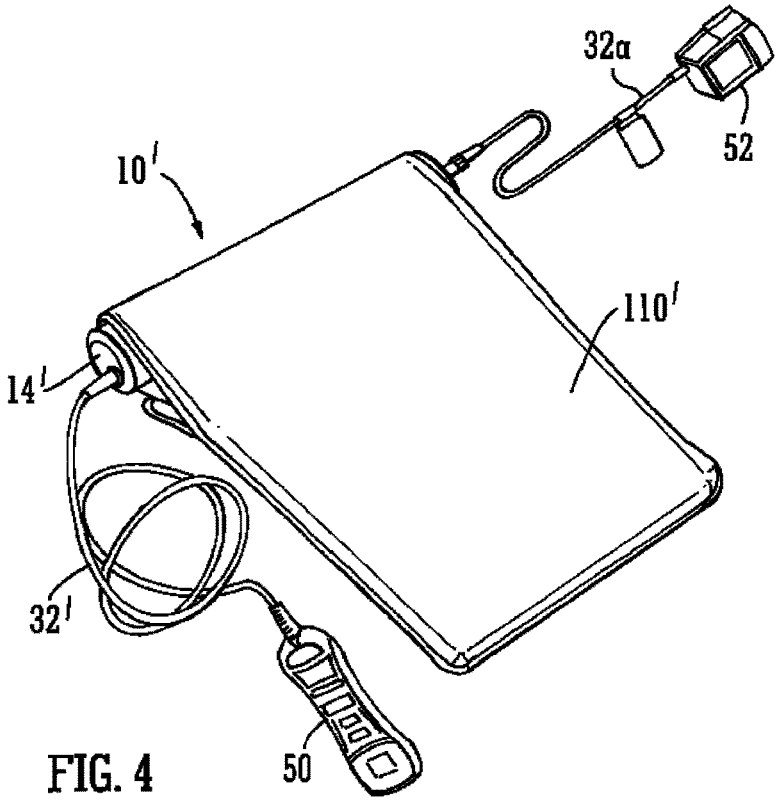
FIG. 4 a perspective view of a vibratory device in accordance with the invention.

A preferred alternative form of the device 10', in accordance with the present invention, is shown in FIG. 4. The same parts are given the same reference numerals, except where there is a change, in which case the corresponding part has an apostrophe. The motor casing 14' is here longer and the frame (not visible) is likewise wider so that two of a patient's legs can rest on the pad 110' and be treated simultaneously. This has particular relevance to peripheral arterial disease in the lower limbs of patients where there is usually a correspondence in the condition of each leg. The spacing between the side edges of the pad is about 375 mm. The spacing between the top and bottom edges of the pad is about 550 mm. The top edge is about 365 mm in length and the bottom edge is about 340 mm in length.

Cable 32' leads to a controller or control unit 50, by means of which the pad 110' may be operated. The controller 50 may include a recorder (not shown) in the form of a memory or storage device. The recorder records the occasions of application of the device. Indeed, the pad 110' may include a leg detector (not shown) that may comprise a pressure sensor or another sensor. For example, this could be by pressing on the pad 110' through the action of gravity on the weight of the patient's limb(s). The recorder thus not only records the time over which a treatment is effected but also that a limb or limbs were in contact with the pad during some or all of such application.

The controller 50 may be configured (pre-programmed) to permit the motor to be switched on at predetermined times. It may be enabled to switch off only after a predetermined period of time. Indeed, the control may be programmed (or otherwise set) to permit only a predetermined number of sessions to be instigated by the user, and possibly over a predetermined time frame. For example, over a week of applications, where the prescribed treatment is three 30 minute sessions per day, the control may be set to operate the device only between the hours of 06:00 to 11:00 for a first 30 minute time period; between 11:00 and 16:00 for a second 30 minute time period, with the second period not being capable of starting until at least three hours had elapsed from the first session; and between 16:00 and 20:00 for a third 30 minute time period, with the third period not being capable of starting until at least three hours had elapsed from the second session. If a session is missed, it may be that the control does not add a further session opportunity later. After seven days, the control disables the device and prevents it from further operation until it is reset, which may require special keys or codes to effect.

The control may also be arranged not to stop the motor once it has started operating, at least not until the end of the allotted treatment period, for example 30 minutes. This, and the foregoing features, may be provided so as to encourage patients to comply with the treatment regime prescribed for them. The recording enables that compliance to be monitored, and the restrictions on use, and the fact that, once started, the device does not stop, serves to oblige patients to be more disciplined in their compliance with the treatment.

In a preferred embodiment, the control unit 50 is attached to the rest of the apparatus through a selectively disconnectible electrical connector (see below), allowing the control unit to be detached from the rest of the apparatus and replaced with another control unit if desired. The control unit can be programmed to provide a desired treatment regime while detached from the rest of the apparatus, and at the end of a treatment regime the control unit may be replaced with a new control to prepare the apparatus for the delivery of a new treatment regime. This may be particularly advantageous if the apparatus is programmed to deliver a specified number of cycles (for example, 400 treatment cycles of 30 minutes duration each) before disabling and requiring reprogramming, which may take place at a follow up appointment and may require special codes or access keys to effect. Additionally, in this embodiment, the control unit can be easily replaced without the need to replace the rest of the apparatus if the control unit becomes damaged.

A second cable **32*a* is a power cable and leads either to a mains adapter for connection to mains electricity or, as shown, to a battery pack 52 for unrestricted use of the pad away from the limitations of mains power. Indeed, the pad may only be driven by the battery 52 and may be arranged not to be disconnectible from the housing 14'. In this case, the battery 52 will have a port for connection of a charger that may itself be selectively connected to a mains electricity supply. It is feasible for the battery 52 to be integrated in the housing 14'. However, this does have an adverse effect on the vibration given its mass. Also, the battery 52 could be integrated with the controller 50**, so that it is charged when the controller is detached from the motor and when the controller is being reprogrammed. Disposable batteries may be employed instead of rechargeable batteries.

Figure 8:
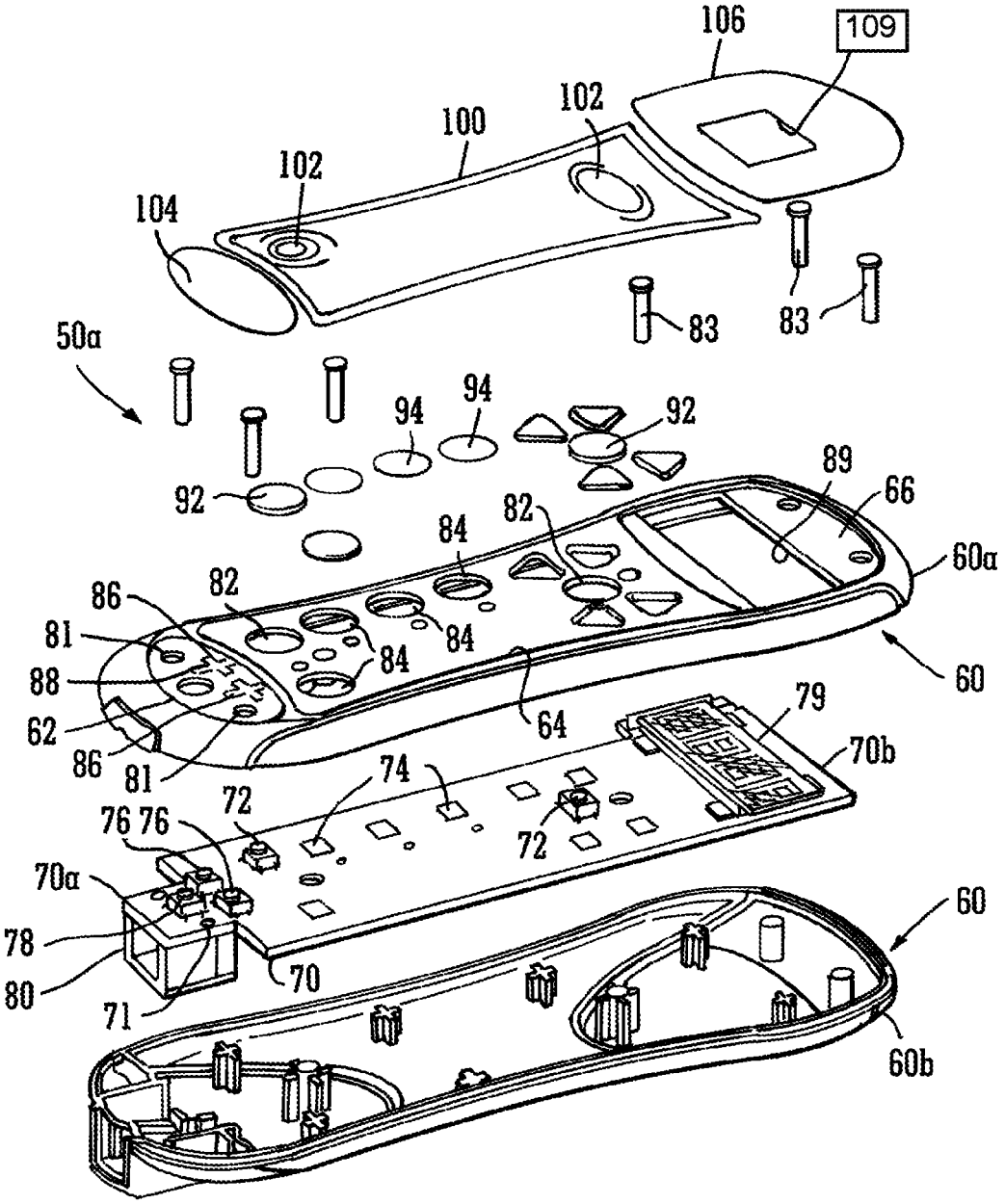
FIG. 8 is an exploded view of a controller suitable for a treatment device in accordance with an aspect of the present invention.
Figure 9:
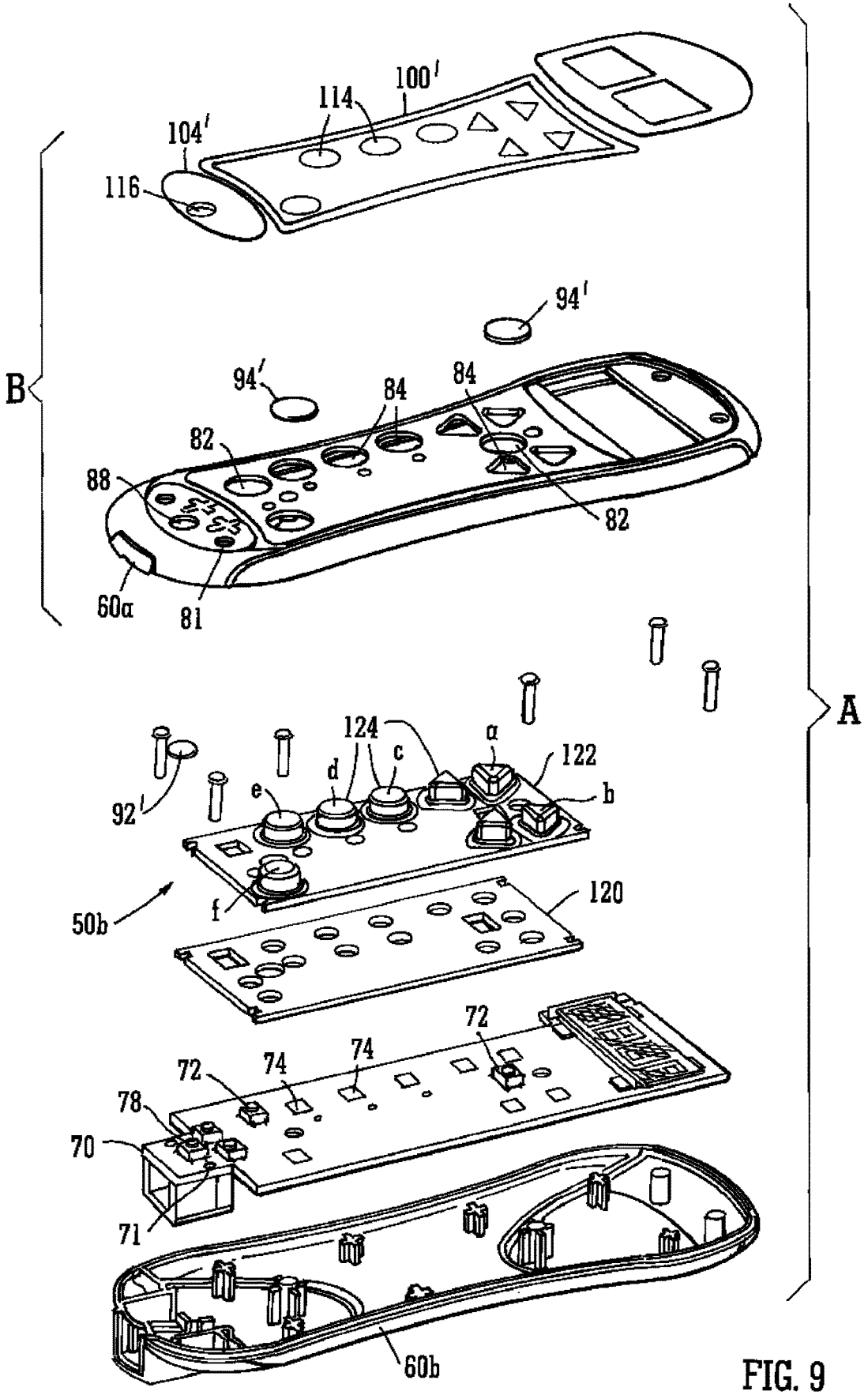
FIG. 9 is an exploded view of another version of the controller, with a modification in the top part of the drawing.
Figure 9:
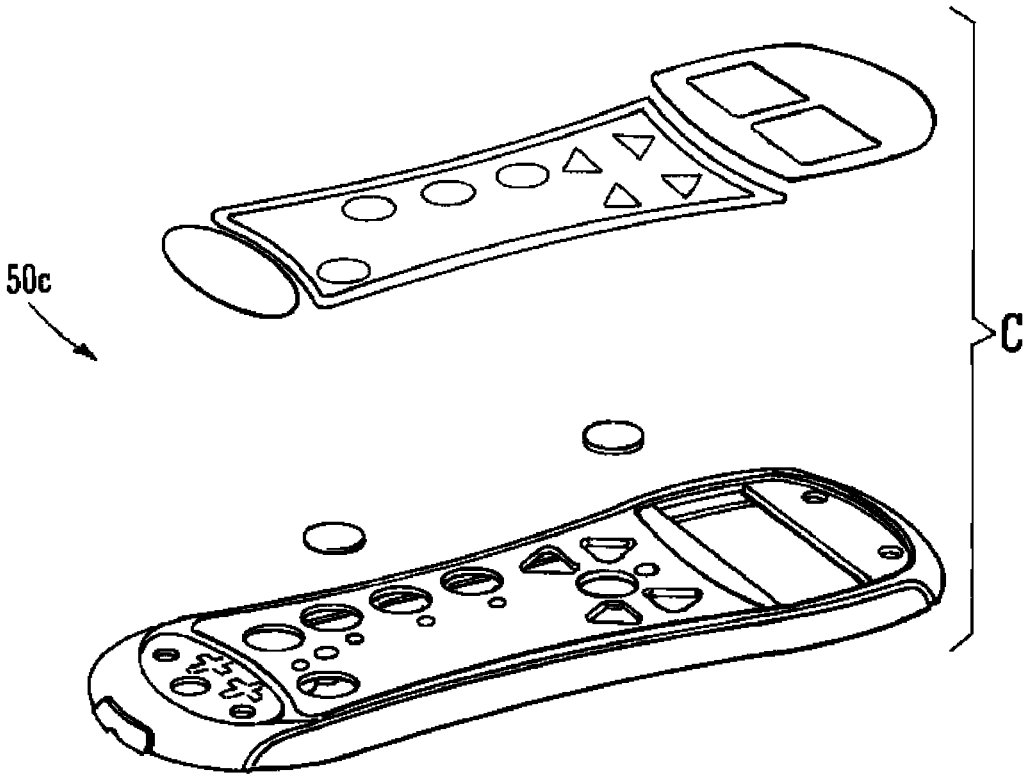

Turning to FIGS. 8 and 9, a form of controller 50 is shown which has the fundamental capacity to perform three modes of operating a treatment device, whilst requiring a minimum of changes to achieve. A first mode of operating is provided by controller 50A shown in FIG. 8. Here, the controller 50A has a casing 60 in two parts, a clamshell base casing **60*a* and a clamshell top casing 60*b*. In the casing is a circuit board 70, having major switches 72 and minor switches 74. Major switches 72 comprise switch bodies fixed on the circuit board 70, whereas minor switches 74 are merely printed circuit tracks for bridging by a pad (see below) to make and break the switch. Also, two tool switches 76 are provided at one end 70*a* of the board, along with a further major switch 78. At the end 70*a* is also provided a socket 80 for receipt of a plug (not shown) from the vibration treatment device to which the controller is to be connected. The board 70 at its other end 70*b* has a four-digit display 79. One or more LED lights 71 may also be on the board 70 at the end 70*a***. On its underside, the board has circuit components (not visible) including a programmable chip.

The board 70 is captured between the clamshells **60*a,b* and held together by screws 83. The top clamshell 60*a*** has a plurality of apertures comprising:

a. a display window 89, to coincide with the display 79 on the board 70;

b. a number of major button apertures 82,88, that coincide with the major switches 72,78;

c. a number of minor button apertures 84, that coincide with the minor switches 74; and d. a number of tool apertures 86, to coincide with the tool switches 76; and e. a number of LED apertures 81, to coincide with the LEDs 71 on the board 70.

The tool switches 76, major switch 78 and LEDs 71 are grouped together at the end 70*a* of the board, so that the apertures 81, 86 and 88 are also in a confined area 62 of the top surface of the clamshell 60*a*. The major switches 72 and minor switches 74 are grouped in a central area of the board, and so a corresponding central area 64 of the top surface 60*a* encompasses the apertures 82,84. Finally, an area 66 of the top surface 60*a* encompasses the display aperture or window 89.

In a first use of the controller, as shown in FIG. 8, none of the minor switches 74 are to be employed. In this arrangement, caps 94 are inserted in the respective minor button apertures 84, which apertures have ledges to receive the caps, so that they are flush with the surface 64. However, major button apertures 82 receive transmission rods 92 that slide in the apertures 82. Then, self-adhesive main face or cover plate 100 is applied to the surface 64 covering all the apertures in that region and retaining the caps 94 in place. The plate 100 may be formed from spring metallic material and, above the transmission rods 92, it may be formed with a bubble 102 which, when depressed by a user, deflects and, in so doing, depresses the rod 92 and actuates the switch 72 beneath.

Two other self-adhesive face plates are also provided, tool plate 104 and display plate 106. Tool plate 104 covers region 62 and in this arrangement has no function other than to cover the apertures in that region. Display plate 106 has a display window 109 that exposes the two middle digits of the display 79.

Thus there are two user actuatable buttons in the first arrangement shown in FIG. 8, one of which may be a power On/Off button and the second may be a Start/Stop button. Although such an arrangement is simple, nevertheless, this controller may be used in several formats. Consequently, before tool face plate 104 is affixed, the two switches 76 are actuated with a tool through the windows 86. These switches may be rotary switches and may each have four positions, providing the options shown in Table A below and further described with reference thereto.

However, turning now to FIG. 9, controller 50B illustrated therein differs from the controller 50A of FIG. 8 by having minor switches 74 operational. A cover plate 120 supports a resiliently flexible membrane button pad 122 having button mounds 124 adapted to protrude through the apertures 84 of the casing shell 60*a*. The plate 120 and pad 122 are received on and between the board 70 and shell 60*a*. Each button mound incorporates a probe (not visible) with a conductor on its base which, when depressed by a user contacts the probe with the printed tracks 74 on the board and completes the switch.

A different self-adhesive main face plate 100' is employed that includes apertures 114 to receive the button mounds 124. Here, major switches 72 are not employed, so blanking plates 94' are received in apertures 82. Plates 94' are in fact identical to plates 94 of FIG. 8, although not essentially so.

Switches 74 can be used to control:

a. Time of operation of the device, using arrow type up or down triangular buttons to increase or decrease the length of a session;

b. Speed of operation of the device, using arrow type up or down triangular buttons to increase or decrease the speed of the device, essentially varying the voltage applied;

c. Cycloid action, meaning constant vibration speed d. Polymodulation, meaning cycling the speed of the device (toggles with operation of switch c)

e. Memory, to store the currently selected speed f. On/Off;

where a. to f. above refer to the switch buttons 124 indicated in FIG. 9.

Thus controller 50B, different from controller 50A is arranged to be able to vary the manner in which the device to which it is attached is employed. Since this is likely to be used in more in a relaxed, massaging-type of application not required necessarily to meet any specific treatment regime, there is not a requirement for fixed and approved specific methodology and a user may be permitted to select what regime is desirable.

Furthermore, in this mode 50B of the controller, a transmission rod 92' is received in aperture 88 and this is used to operate switch 78. When switch 78 is toggled, the controller is arranged to control either one of two motors 14' which, in this case, are disposed, not in a pad-type treatment device as described above with reference to FIGS. 1 to 4, but in a mattress or chair where two vibration devices are installed. In a chair, one device may be installed in the seat, and the other in a backrest. In a mattress, one may be installed at a leg and of the mattress, and the other in a head/shoulders end of the mattress. In these instances it may be desirable to be able to adjust the motors independently of one another. Thus tool face plate 104' here has aperture 116 to receive rod 92' for user actuation and LEDs 71 alternately illuminate to indicate which motor is being adjusted, the LEDs being visible through apertures 81 in the casing 60*a*, and translucent patches of the tool cover plate 104'.

Finally, there is a third mode of controller 50C (also shown FIG. 9, but in part C thereof, as components to replace the corresponding components (in part B FIG. 9) of the complete controller 50B shown in part A of FIG. 9). In this mode, transmission rod 92' is omitted and tool cover plate 104' replaces that of controller 50B so that switch 78 is rendered inaccessible. A different main cover plate 100" may also be employed and the function of button e changed to implement a relaxing rhythm function, that is, a slower and smoother rate of change of speed, and which toggles with switch c.

As described above, which functionality of the controller is provided depends on the selection of the tool switches 76, whose options are set out in Table A below:

TABLE A

| | MODE | LEFT-HAND SWITCH | RIGHT-HAND SWITCH |
|---|---|---|---|
| 1 | CSTP (12 V) | ↑ | ↑ |
| | CSTP (12 V) | ↑ | → |

TABLE A-continued

| MODE | LEFT-HAND SWITCH | RIGHT-HAND SWITCH |
|---|---|---|
| CSTP (11 V) | ↑ | ← |
| CSTP (12 V) | ↑ | ↓ |
| 2 MATTRESS (12 V) | → | ↑ |
| MATTRESS (12 V) | → | → |
| MATTRESS (12 V) | → | ↓ |
| MATTRESS (12 V) | → | ← |
| 3 VIBRO-PULSE(6 V no cover + sessions count) | ↓ | ↑ |
| VIBRO-PULSE(6 V 3 off 30 minute sessions + sessions count) | ↓ | → |
| VIBRO-PULSE(6 V 3 off 30 minute sessions no sessions count) | ↓ | ↓ |
| VIBRO-PULSE(6 V no cover no count 30 minute sessions) | ↓ | ← |
| 4 TEST1 (LEDs, VERSION and cover fuse status) | ← | ↑ |
| TEST2 (DISPLAY SESSIONS COUNTER VALUE) | ← | → |
| TEST3 (DISPLAY BUTTON NUMBER VALUE) | ← | ↓ |
| TEST4 (DISPLAY PSU VOLTS) | ← | ← |

The arrows indicate the orientation of each switch 76. Thus, for each of four possible orientations of the Left-hand switch (L), there are four possible orientations of the Right-Hand switch (R), giving sixteen different combinations. Left and right are here just for convenience of labeling, they may have any arrangement on the board 70.

1. When the L switch is pointing up, the orientation of the R switch is irrelevant and the controller is in CSTP mode, described further below.
2. When the L switch is pointing right, the orientation of the R switch is irrelevant and the controller is in Mattress mode, described further below.
3. When the L switch is pointing down, the controller is in Vibro-Pulse Mode, with four options depending on the position of the R switch, described further below.
4. When the L switch is pointing left, the controller is in Test Mode, with four options depending on the position of the R switch, described further below.

Vibro-Pulse Mode

In this mode, the device to which the controller is connected will operate at 6V only and in a fixes regime depending on the application. In the case where the treatment is such as described in WO-A-2008/135788 where a patient may have an open wound that potentially will suppurate during treatment, it is desirable that a cover be applied to the treatment device (generally a pad) which cover can have detection equipment included within it connected to the pad and thus to the controller through cable 32' and socket 80. Treat of PAD, however, does not carry significant risk of cross infection and so no cover is required. Thus, in this mode the four options may be:

5. No cover required, sessions (treatment cycles) to last 30 minutes; count sessions employed; disable unit after eg 300 sessions.
6. Cover required—disable unless cover detected; sessions (treatment cycles) to last 30 minutes; count sessions employed; disable after three sessions unless cover replaced; disable unit after eg 300 sessions in total.
7. Cover required—disable unless cover detected; sessions (treatment cycles) to last 30 minutes; count sessions employed; disable after three sessions unless cover replaced; no overall sessions count.
8. No cover required, sessions (treatment cycles) to last 30 minutes; no overall sessions count.

When this mode of selection is made, the controller has no requirement for the adjustment possibilities described with reference to controller formats 50B or 50C above and with reference to FIG. 9. Instead the format 50A of FIG. 8 is employed. If, after a period of use and the controller has been disabled and returned to a hospital, it can be "reprogrammed" simply by removing the tool face plate 104 and turning the switches 76 to a different position to reset a program on the board 70.

It is to be understood that this is an essentially medical mode and one aspect of that is the requirement to be able to wipe clean the device and controller which can be achieved with the main face plate 100.

Mattress Mode

In the mattress mode there is only one mode, operating at higher voltage (12V), the position of the right-hand switch not being relevant. In the mattress mode, as described above, the controller is in its format 50B as shown in FIG. 9, where there is the opportunity to select between controlling independently different ones of two devices to provide: Adjustable Time; Adjustable Vibration level; Polymodulation Vibration rhythm; and Memory mode. At the higher voltage, there is more opportunity to intensify the vibrations experienced.

CSTP Mode

Circulation Stimulation Therapy Pad mode uses format 50C as described above and also 12V. However, this is for a single vibration motor, disposed in a PAD product format, for example as described above with reference to FIGS. 1 to 4. Again the format allows for: Adjustable Time; Adjustable Vibration level; Polymodulation Vibration rhythm; Relaxing rhythm Vibration rhythm.

Both the Mattress mode and CSTP modes are not necessarily for medical treatment applications and therefore do not require the ability to be cleaned antiseptically, or approximately so.

Test Mode

The Test mode is employed to test or display the elements mentioned in Table A above. These do not provide different modes of operation.

Study

Eskamed Vascular and Wound Care Clinic, (ESKAMED, s.r.o. Chirurgická ambulancia, MUDr.Emil Jurkovič, ul. 17 novembra, 955 01 Topoľčany, Slovakia.) is a Slovakian independent vascular and wound care clinic, treating about 7,000 patients a year, of which 2,000 cases include wound care. Five out-patients attending the clinic and suffering with varying levels of lower extremity PAD agreed to participate in the evaluation.

As part of standard practice care and assessment, the following measurements were taken in both legs at the start of treatment with Sinusoidal Vibration Therapy (SVT), Vascular doppler analysis (Vascular Dopplex Assist, Model No: VAS 1 with spectral analysis; Huntleigh Diagnostics).

Ankle-Brachial Index (ABI), reviewing primarily the dorsal pedis, anterior and posterior tibial arteries.

As per current recognised clinical thresholds for ABI anything below 0.5 was classed as critical limb ischemia, and less than 0.9 as PAD. Walking was assessed by means of a controlled distance test before pain was experienced, and this was allocated a Stage I to III Fontaine Classification:

Stage I: Asymptomatic, incomplete blood vessel obstruction

Stage II: Mild claudication

Stage IIA: Claudication at a distance of greater than 200 metres

Stage IIB: Claudication distance of less than 200 metres

Stage III: Rest pain, mostly in the feet

After assessment, the patients were shown how to operate and self-apply the SVT unit to the lower limb. The SVT unit was only to be applied to the limb most severely affected by PAD. The patient was instructed to apply the SVT to the chosen lower limb twice a day for 30 minutes for a period of 12 weeks. As per the clinics standard practice ABI's and walking distance before pain assessments were then repeated on both lower limbs at weeks 4, 8 and 12 and a comparison made between the SVT treated lower limb and the un-treated limb, patient comments were also noted.

Results

Case Summaries.

Patient 1—a 77 year old male who was seen in February 2012 with history of left calf claudication at 80 metres. He was initially diagnosed with PAD in 2011 and at that time had a claudication distance of 100 metres (Fontaine IIb). Past medical history included ischaemic heart disease and hypertension. He smoked 20 cigarettes a day up to the age of 67. He had reduced this since to 3 or 4 cigarettes daily, stopping fully 6 months before the study. Arterial imaging confirmed arterial occlusion of both the anterior and posterior tibial arteries in both limbs with predominance in the left. In 2011, conservative therapy of Naftidrofuryl 3×200 mg and Ticlopidine 2×250 mg was commenced and exercise was advised. The options for revascularisation were discussed but declined by the patient. On assessment in February 2012, a deterioration in walking and a reduction in the claudication interval to 80 metres was noted. As a consequence, use of SVT was proposed to the left leg twice a day, together with current drug therapy.

Patient 2—a 55 year old male seen in February 2012 with a deterioration in walking and a claudication interval of 200 meters (Fontaine IIb). Doppler assessment showed closure of the left anterior and dorsal pedis arteries. The limb's extremities were supplied by collateral circulation. The patient was initially diagnosed with PAD in 2001 (Fontaine I), a smoker of 20 cigarettes a day since the age of 18. In 2005 he experienced deterioration in walking with pain in the right calf after 1000 metres. Doppler assessment showed closure of the right leg posterior tibial artery with good compensation of flow through the anterior tibial. He was prescribed vasodilation and anti-coagulation therapy, a ban on smoking, and walking exercise. In 2009 his condition worsened with a shortening of the claudication interval to 500 metres. After previous improvement the patient had been non-concordant with medication and continued to smoke. Initial signs of ischaemic heart diseases and arterial hypertension were observed resulting in a coronary bypass in 2011 and the patient stopping smoking. In February 2012, application of SVT was proposed to the left leg only twice a day for 30 minutes, alongside prescribed Naftidrofuryl, Aspirin, Sulodexide, and Rosuvastatin.

Patient 3—a 61 year old man diagnosed with PAD and first seen in April 2012 after his condition had worsened with predominance to the left leg showing closure of the left anterior and dorsal pedis arteries and a claudication walking interval of 150 metres (Fontaine IIb). A smoker of 20-30 cigarettes a day since the age of 15, he had stopped smoking at the age of 45. Severe PAD and critical lower limb ischemia was first diagnosed end of 2006 with claudication pain less than 50 metres (Fontaine IIIc). Early 2007 he had aleft aortofemoral bypass and his walking distance improved to 500 metres. In April 2012, application of SVT was proposed to the more affected left leg only, twice a day alongside prescribed Naftidrofuryl, Pentoxifylin and Ticlopidine.

Patient 4—a 68 year old man see in May 2012, presented for assessment with significantly worsened walking and ischaemic pain in the right calf at 130 metres (Fontaine IIb) and progressive occlusion of the arteries including a fully occluded right posterior tibial. First diagnosed with PAD in 1998 and a non-smoker. The claudication interval could not be determined because of coxarthrosis. The Doppler readings showed serious occlusion in the area of the communal femoral artery. A subtracted digital angiograph was taken with a subsequent re-constructive bypass on the communal iliac artery. Walking distance increased to 500 metres. From 1992 to date, the patient had suffered numerous spinal disc and left hip problems resulting in numerous surgical procedures including in 1999 joint and re-implantation of the acetabulum and in 2007 spinal surgery. In May 2012 initial application of SVT was proposed to the more affected right leg only, twice a day alongside prescribed Naftidrofuryl, Pentoxifylin and Ticlopidine.

Patient 5—a 55 year old male was seen with worsening recorded claudication pain after 50 m (Fontaine IIc) and recorded rest pain. On assessment severe arterial occlusive disease with predominance in the left leg was determined resulting in occlusion of the posterior and anterior tibial arteries. The patient had a history of hypertension, disorders of lipid metabolism: a smoker for 24 years of 20 cigarettes a day. In August 2011, the patient was assessed in clinic after a couple of months of walking pain in the left leg after 100 meters (Fontaine IIb). Subtraction digital angiography and subsequent revascularization procedures on the arterial system were proposed, but on consultation the surgery was deferred with a more conservative approach instigated in the first instance. This included application of SVT to the more affected left leg only, twice a day alongside prescribed Naftidrofuryl, Trombex and Atoris (statin) and stopping smoking.

Claudication Walking Pain

Figure 5:
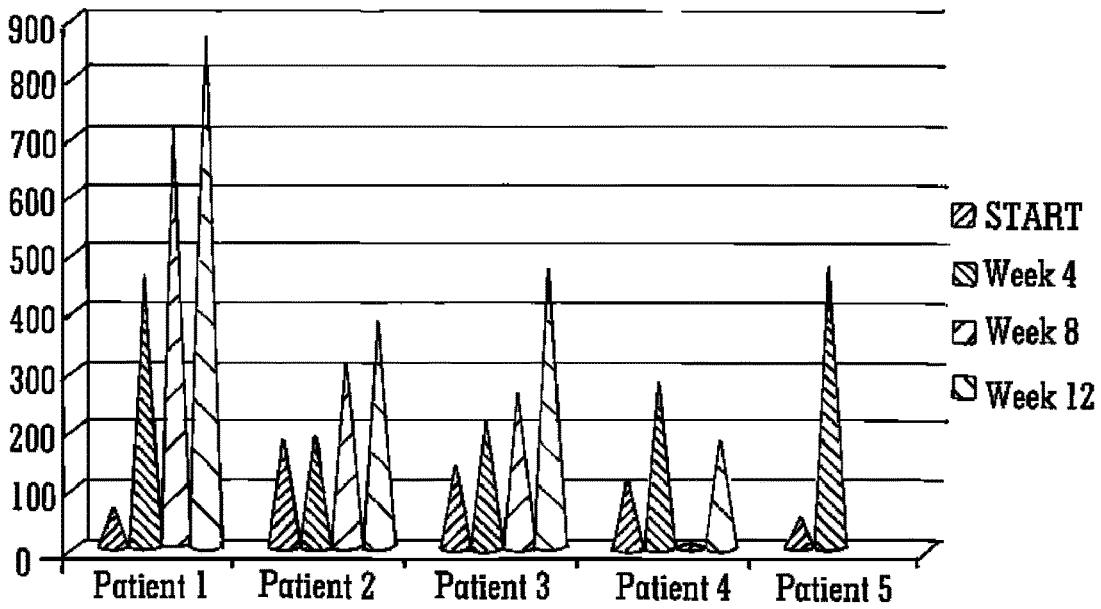
FIG. 5 is a pictogram of walking distance in metres before claudication of patients in a study after periods of the study.

On commencing use of SVT the average walking distance before pain for the 5 patients was 126 meters, Fontaine IIb (range 50 meters to 200 meters). After 4 weeks of use the average claudication walking distance was 344 meters (Fontaine IIc) an increase of 273% (range 220 meters to 500 meters). At week 5, Patient 5 stopped the use of the SVT as walking distance before pain had improved from 50 meters to 500 meters; an increase of 1000%. By week 12, the average walking distance before pain for the remaining 4 patients was 500 meters (Fontaine IIa) an increase of 397% (range 200 meters to 900 meters). (Patient 4 at week 8 did not attend clinic for assessment.) Refer to FIG. 5 for a graphic representation of the foregoing.

Ankle-Brachial Index Comparison of the Un-Treated Lower Limb to the SVT Lower Limb On reviewing the ABI of all the major arteries of the lower limb, looking specifically at the posterior and anterior tibial arteries and the dorsal pedis:

the dorsal pedis. The average ABI index in the SVT limb increased by 179% compared to −1% change in the un-treated lower limb (Table 1).

Posterior tibial artery. The average ABI index in the SVT limb increased by 209% compared to −1.5% in the un-treated lower limb (Table 2.)

Anterior tibial artery. The average ABI index in the SVT limb increased by 210% compared to −11% change in the un-treated lower limb (Table 3).

Figure 6:
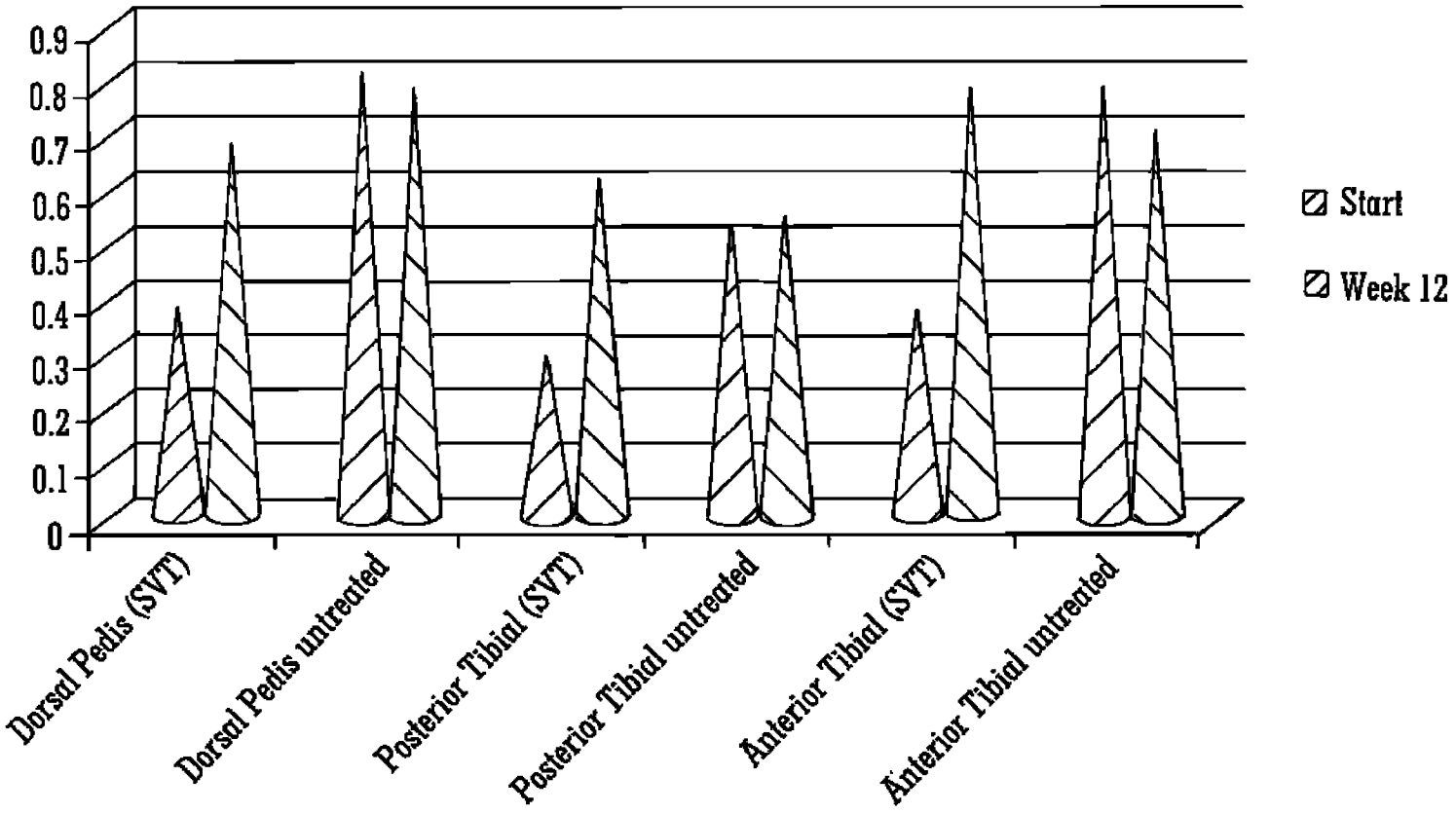
FIG. 6 is a pictogram of average ABI of different arteries in the patient study group before and after treatment.

These figures are also shown graphically in FIG. 6.

TABLE 1

| | Average ABI index dorsal pedis | |
|---|---|---|
| | SVT treated | Un-treated |
| Start (range) | 0.39 (0 to 0.79) | 0.82 (0.53 to 1.1) |
| Week 12 (range) | 0.70 (0.39 to 0.91) | 0.81 (0.61 to 1) |

TABLE 2

| | Average ABI index posterior tibial | |
|---|---|---|
| | SVT treated | Un-treated |
| Start (range) | 0.31 (0 to 0.82) | 0.56 (0.42 to 0.67) |
| Week 12 (range) | 0.65 (0.36 to 0.91) | 0.57 (0 to 0.85) |

TABLE 3

| | Average ABI index anterior tibial | |
|---|---|---|
| | SVT treated | Un-treated |
| Start (range) | 0.38 (0 to 0.77) | 0.82 (0.52 to 1.2) |
| Week 12 (range) | 0.8 (0.42 to 0.99) | 0.73 (0.51 to 0.97) |

All patients were compliant with treatment and found it comfortable to use. They all reported improved warmth in the SVT treated lower limb. Patient 1 reported improved general limb health and improved free moving-gait. The improvement experienced by Patient 2 following the 12 weeks had motivated the patient to undertake muscle exercise and walking. Patient 5 reported he felt considerably better after the applications of SVT.

DISCUSSION

The study demonstrated an increase in pain-free walking distance of 397%. Supervised exercise programs are advised for patients with intermittent claudication and reviews of larger scale studies have shown an average increase of walking distance of 100% before pain (18). However patient concordance and compliance to undertake exercise remains low and dropout rates for supervised exercise are high (9). A review the haemodynamic changes shows that in both lower limbs of the patients there was before the study a progressive arterial occlusion with average ABI<0.9. SVT was applied to the most affected lower limb, with average ABI<0.5 for the dorsal pedis, anterior and posterior arteries, indicating the onset of critical lower limb ischemia. The other un-treated lower limb had a corresponding ABI index in the same arteries of <0.9. In the SVT-treated lower limb, there was a recorded ABI increase in the dorsal pedis, anterior and posterior arteries of between 179% and 210%, whereas there was a small decrease of between 1% and 11% recorded in the un-treated leg.

It might have been expected to see a mild to moderate change in the un-treated lower limb, due to the pharmaceutical intervention and improved walking. However, any change would have been smaller due to the higher ABI starting point. Surprisingly, no improvement was demonstrated.

Smoking is a significant risk factor in PAD. Before commencing use of SVT, only Patient 5 was a smoker, the remaining patients having stopped smoking 6 months to 10 years before. Patient 5 (see FIG. 7) had the most dramatic improvement in the SVT treated lower limb. By week 5, his walking distance had improved 1000%. However, his stopping smoking may also have contributed to this improvement.

Figure 7A:
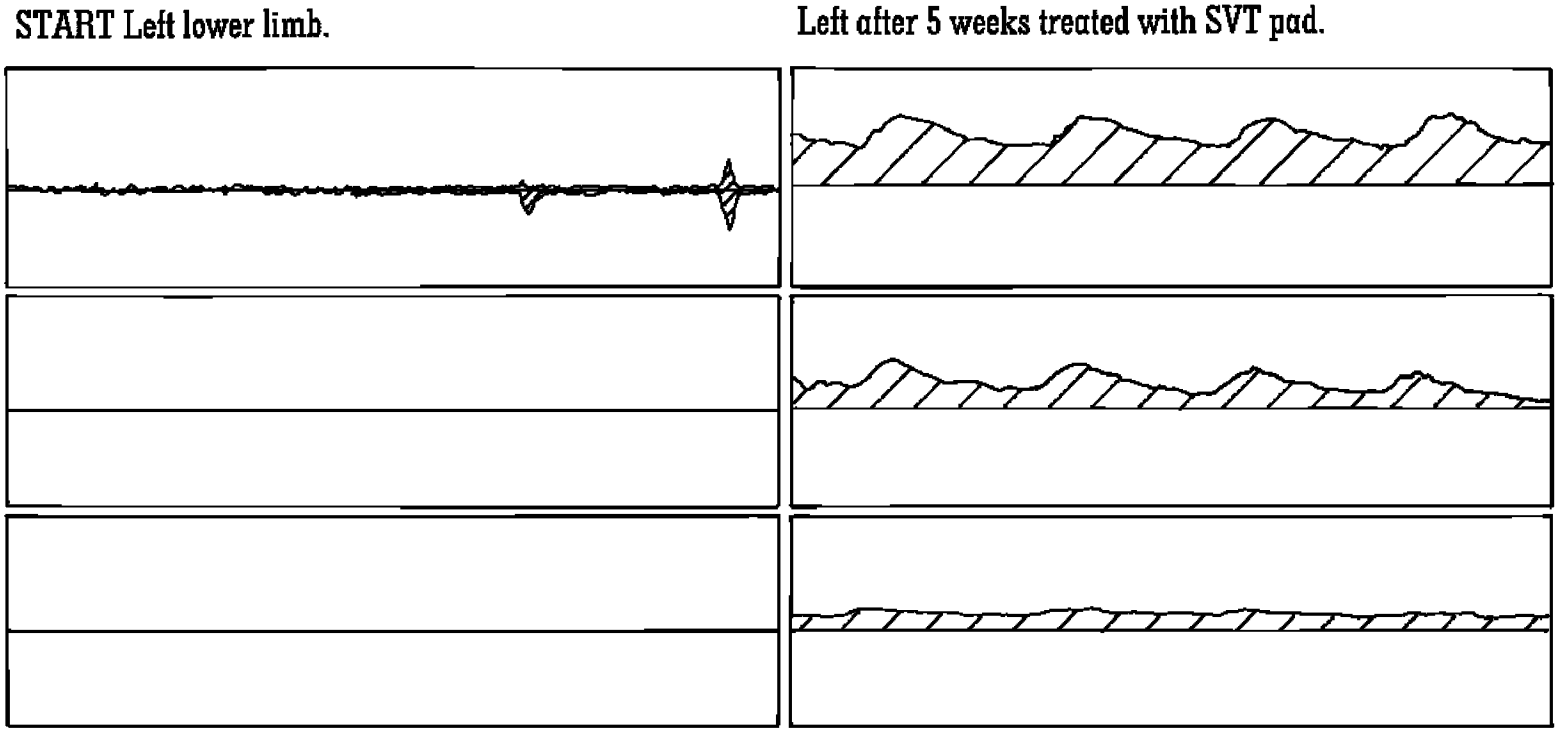
FIG. 7A are vascular doppler analysis traces for Patient 5 left leg anterior, posterior tibial and dorsal pedis arteries at the start and end of 5 weeks treatment according to the present invention.
Figure 7B:
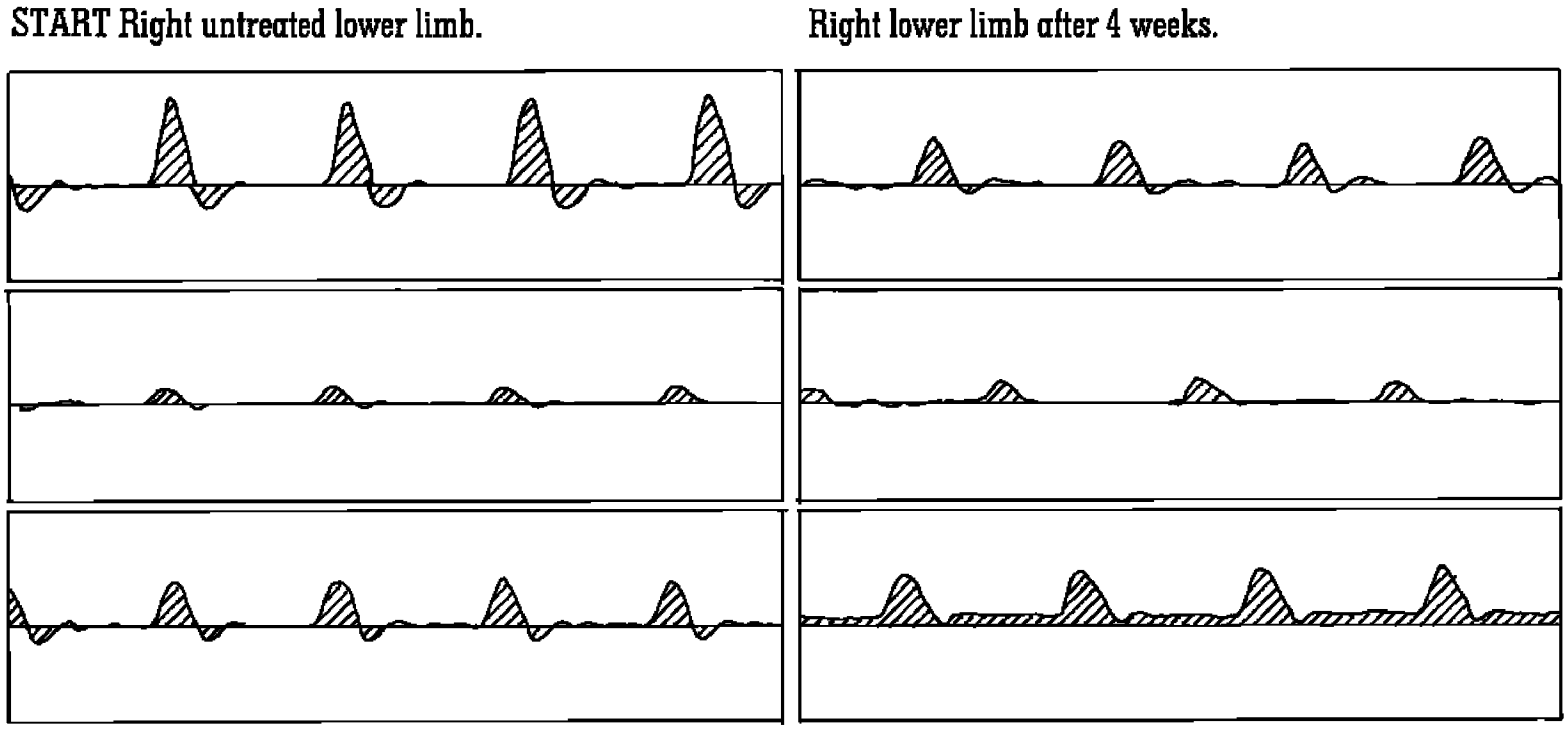
FIG. 7B are vascular doppler analysis traces for Patient 5 right leg anterior, posterior tibial and dorsal pedis arteries at the start and end of 5 weeks treatment according to the present invention.

Referring to FIG. 7, the un-treated lower limb of Patient 5 had a clear signs of progressive arterial occlusion at the START of the study (top left, showing Doppler traces for anterior tibial, posterior tibial and dor pedis arteries respectively). After 5 weeks of treatment, the improvement of these arteries is evident from the top right traces. It may have been expected to see improvement in arteries in both lower limbs. However this was not the case in respect of the untreated right leg. In FIG. 7, the bottom left and bottom right traces show that there was no significant change in the dorsal pedis, anterior and posterior tibial arteries of the untreated right leg.

Nitric Oxide synthase (NOS) impairment has been shown to play a role in PAD (11). Stimulating NOS using L-arginine has shown increases in femoral blood flows in patients with critical lower limb ischemia. These have improved walking distances and provided symptom relief (19). Nitric Oxide also has been shown to play a role in angiogenesis, stimulating both vascular endothelial and fibroblast growth factors (20). Angiogenesis is stimulated when a shear stress is applied to a layer of endothelial cells and also when flow is induced normal to (through) an endothelial monolayer, resulting in vascular sprouting (21). Vascular Endothelial Growth Factors (VEGF) are a critical signal protein in angiogenesis and it has been shown that in healthy adults non-invasive vibration stimulation also increase's growth factor VEGF levels compared to physical exercise alone (22). Increasing NOS, vasodilation and resulting laminar flow shear stress at the point of artherosclerosis could increase angiogenesis activity and aid collaterals formation. SVT has been shown to stimulate blood flow and this has been considered to be through two combined mechanisms: nerve axon reflex-related vasodilation of blood vessels, as type IIa fibres in muscle tissue have been shown to have similar contraction rates as the SVT frequency range (23, 24); and the stimulation of NOS by means of mechano-transduction of vascular endothelial cells (13,16,17).

SVT is a low cost, easy to use intervention, with a high rate of compliance. In the small observational case study described above, SVT has been shown to be effective in increasing lower limb circulation and subsequent pain free walking distance for lower extremity PAD patients.

Stimulation of local production of nitric oxide resulting in relaxing of the smooth muscle in the vascular walls and resulting in vasodilation has improved necessary blood supply to the lower limb, with potential collateral circulation to achieve improvements in limb blood perfusion. SVT applied to the ischemic limb in this study had a positive affect with a clear prolongation of the claudication distance and an increase in ABI observed in the main arteries. Given that all of the patients' pain free walking distance had substantially increased, the previously considered surgical re-vascularisation was no longer indicated.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

REFERENCES (1). L. Norgren, W. R. Hiatt, J. A. Dormandy, M. R. Nehler, K. A. Harris, and F. G. R. Fowkes, "Inter-society consensus for the management of peripheral arterial disease (TASC II)," Journal of Vascular Surgery, 2007 vol. 45, no. 1, pp. S5-S67.

(2). Meijer W T, Hoes A W, Rutgers D, Bots M L, Hofman A, Grobbee D E: Peripheral arterial disease in the elderly: The Rotterdam Study. Arterioscler Thromb Vasc Biol 1998, 18(2):185-192.

(3). Criqui M H, Langer R D, Fronek A, Feigelson H S, Klauber M R, McCann T J, Browner D: Mortality over a period of 10 years in patients with peripheral arterial disease. N Engl J Med 1992, 326(6):381-386.

(4). Shammas N W, Dippel E J. Evidence-based management of peripheral vascular disease. Curr Atheroscler Rep, 2005. 7:358-63.

(5). Norgren L, Hiatt W R, Dormandy J A, Nehler M R, Harris K A, Fowkes F G, TASC II Working Group. Inter-society Consensus for the management of peripheral arterial disease (TASC II). Eur J Vasc Endovasc Surg 2007; 33:51e75.

(6). Anna Franzone, Marco Ferrone, Giuseppe Carotenuto, Andreina Carbone, Laura Scudiero et al. The role of atherectomy in the treatment of lower extremity peripheral artery disease. BMC Surgery 2012, 12(Suppl 1):513

(7). Lower limb peripheral arterial disease. Methods, evidence and recommendations. NICE Clinical guideline 147 UK. 2012 August.

(8). Makris G C, Lattimer C R, Lavida A, Geroulakos G. Availability of Supervised Exercise Programs and the Role of Structured Home-based Exercise in Peripheral Arterial Disease. Eur J Vasc Endovasc Surg. 2012 December; 44(6):569-75. doi: 10.1016/j.ejvs.2012.09.009. Epub 2012 Sep. 30.

(9). Müler-Bühl U, Engeser P, Leutgeb R, Szecsenyi J. Low attendance of patients with intermittent claudication in a German community-based walking exercise program. Int Angiol. 2012 June; 31(3):271-5.

(10). R. M. J. Palmer, D. S. Ashton, and S. Moncada, Vascular endothelial cells synthesize nitric oxide from L-arginine. Nature, 1988 vol. 333, no. 6174, pp. 664-666.

(11). R. H. Böger, S. M. Bode-Böger, W. Thiele, W. Junker, K. Alexander, and J. C. Frölich, Biochemical evidence for impaired nitric oxide synthesis in patients with peripheral arterial occlusive disease. Circulation, 1997 vol. 95, no. 8, pp. 2068-2074.

(12). Button C., Anderson N., Bradford C., Cotter J D. and Ainslie P N. The effect of multidirectional mechanical vibration on peripheral circulation of humans. Clin Physiol Funct Imaging. 2007 July(4):211-6.

(13). Sackner M A, Gummels E, Adams J A. Nitric Oxide is released into circulation with whole-body, periodic acceleration. Chest, 2005. 127: 30-39.

(14). Lievens P. Professor (PHD). Influence of Cycloidal Vibration on skin blood flow changes observed in vivo microcirculatory blood vessel. Head of the department of Medical Rehabilitation Research. Faculty of Medicine, Vrije Universiteit Brussel, presented: Wounds UK 2011 conference.

(15). Gojiro Nakagami, Hiromi Sanada, Noriko Matsui, Atsuko Kitagawa, Hideki Yokogawa, Naomi Sekiya, Shigeru Ichioka, Junko Sugama, Masahiro Shibata. Effect of vibration on skin blood flow in an in vivo microcirculatory model. BioScience Trends. 2007. 1(3): 161-166.

(16). Ichioka S, Yokogawa H, Nakagami G, Sekiya N, Sanada H. In vivo Analysis of Skin Microcirculation and the Role of Nitric Oxide During Vibration. Ostomy Wound Manage. 2011 September; 57(9):40-7.

(17). Maloney-Hinds C, Petrofsky J S, Zimmerman G). The role of Nitric Oxide in skin blood flow increases due to vibration in healthy adults and adults with type 2 diabetes. Diabetes Technology and Therapeutics. 2009, 11:1; 39-43.

(18). Watson L, Ellis B, Leng G C. Exercise for intermittent claudication. Cochrane Database Syst Rev 2008; (4): CD000990.

(19). S. M. Bode-Böger, R. H. Böger, H. Alfke et al., "L-arginine induces nitric oxide-dependent vasodilation in patients with critical limb ischemia: a randomized, controlled study," Circulation, 1996, vol. 93, no. 1, pp. 85-90.

(20). Ziche and L. Morbidelli, Nitric oxide and angiogenesis, Journal of Neuro-Oncology, 2000, vol. 50, no. 1-2, pp. 139-148.

(21). Ingber D. Mechanical Signaling and the Cellular Response to Extracellular Matrix in Angiogenesis and Cardiovascular Physiology. Circ Res. 2002 Nov. 15; 91(10):877-87.

(22). Suhr F, Brixius K, de Marées M, Bölck B, Kleinöder H, Achtzehn S, Bloch W, Mester J. Effects of short-term vibration and hypoxia during high-intensity cycling exercise on circulating levels of angiogenic regulators in humans. Appl Physiol. 2007. 103: 474-483.

(23). Burnstock G, Ralevic V. New insights into the local regulation of blood flow by perivascular nerves and endothelium. Br J Plast Surg. 1994. 47:527-543.

(24). Rowell L B. Reflex control of regional circulations in humans. J Auton Nerv Syst. 1984. 11:101-114.

The invention claimed is:

1. A treatment device, the treatment device comprising:

a drive unit including a motor having an eccentric weight mounted on a shaft of the motor and adapted to deliver mechanical vibrations at a surface of the motor in three orthogonal directions at a frequency in each orthogonal direction of between 15 and 75 (Hertz) Hz and with an amplitude in each orthogonal direction of between 0.1 and 2 mm;

a frame connected to the drive unit to transmit vibrations to a vibration applicator;

a power source to drive the motor; and a controller for selective connection and disconnection to the drive unit, wherein the controller is programmable to enable a set regime of vibration treatment to be applied, the controller comprising:

a casing, the casing having a surface with button apertures thereon to locate user actuatable buttons and a tool aperture for access by a tool;

a circuit board disposed in the casing and having button switches in positions corresponding to the button apertures and a tool switch in a position corresponding with the tool aperture;

at least one button in a button aperture for operation when depressed of the corresponding button switch on the circuit board;

blanking plates in any button apertures not incorporating buttons, wherein the button switches corresponding with the blanking plates are not employed;

a main cover plate on the controller, the main cover plate covering the blanks and some of the surface of the casing surrounding the blanks and making available for actuation the button or buttons received in the button apertures; and a separate removable cover plate that covers the tool aperture;

wherein the controller and the circuit board are capable of providing different functionality depending on:

a) which button switches are accessible by having buttons in the corresponding button apertures; and b) what condition the tool switch is in, the condition being selectable by operation of the tool switch using the tool through the tool aperture after removal of the removable cover plate.

2. A treatment device as claimed in claim 1, wherein the controller is programmed to permit a preset number of treatment cycles before being disabled.

3. A treatment device as claimed in claim 2, wherein the device is configured to provide a treatment cycle, the treatment cycle comprising a period of operation of the motor for between 20 and 40 minutes.

4. A treatment device as claimed in claim 1, wherein the controller is programmed to permit a preset number of treatment cycles per day.

5. A treatment device as claimed in claim 4, wherein the controller is programmed to permit the preset number of treatment cycles per day within preset timeframes during a day and/or with preset minimum time delays between succeeding treatment cycles.

6. A treatment device as claimed in claim 1, wherein the vibration applicator is selected from the group comprising:

a pad;

a seat-back cushion a seat-seat cushion; and a mattress.

7. A treatment device as claimed in claim 1, wherein some of the button switches are minor button switches and are only employed in only some functionalities of the controller, each minor button switch having a corresponding minor button to operate the minor button switches, the minor buttons being integral with a button pad, wherein each minor button comprises a probe adapted to complete a switch circuit printed on the circuit board, each probe and corresponding switch circuit constituting a minor button switch, the main cover plate making the minor buttons available for actuation by comprising holes through which the minor buttons protrude.

8. A treatment device as claimed in claim 7, wherein some button switches are major button switches and are employed in other functionalities of the controller and comprise a switch device disposed on the circuit board, the button to actuate a major button switch being a major button and comprising a disc for reception in the respective button aperture, said main cover plate making the major buttons available for actuation by comprising a flexible membrane over the major buttons whereby the disc is displaceable by depression of the flexible membrane to actuate the switch device.

9. A treatment device as claimed in claim 1, wherein the controller comprises a start button which, on activation, starts the motor and, once the motor is started, the controller cannot be actuated to stop the motor before a predetermined period of time of a treatment cycle has elapsed.

10. A treatment device as claimed in claim 1, wherein the device is powered by a rechargeable battery.

11. A treatment device as claimed in claim 10, wherein the drive unit is hardwired to the battery that drives the motor, a charging port being provided to enable charging of the battery when it is discharged and when it is connected to a mains adapter.

* * * * *